United States Patent [19]

O'Keefe et al.

[11] Patent Number: 4,640,207

[45] Date of Patent: Feb. 3, 1987

[54] DETACHABLE GUIDE FOR A SEWING MACHINE OPERATING STATION

[75] Inventors: Michael O'Keefe; John R. Fox, both of South Yorkshire, United Kingdom

[73] Assignee: S.R. Gent plc, England

[21] Appl. No.: 754,767

[22] Filed: Jul. 15, 1985

[51] Int. Cl.[4] ..... D05B 33/00

[52] U.S. Cl. ..... 112/236; 112/121.29; 112/260; 198/680; 211/204

[58] Field of Search ..... 198/680, 637, 477.1, 198/465.4; 211/204, 207, 208; 104/88; 112/136, 121.29, 2, 47, 121.15, 260; 269/46

[56] References Cited

U.S. PATENT DOCUMENTS

| | | | |
|---|---|---|---|
| 314,808 | 3/1885 | Denecke | 211/208 X |
| 1,584,889 | 5/1926 | Peebles | 198/637 X |
| 2,264,032 | 11/1941 | Webb | 112/121.29 |
| 2,609,083 | 9/1952 | Leach | 198/680 |
| 3,002,635 | 10/1961 | Holland | 198/680 X |
| 3,282,400 | 11/1966 | Jonson | 198/680 X |
| 3,454,148 | 7/1969 | Harrison | 198/680 |
| 3,507,402 | 4/1970 | Barbee | 211/204 |

FOREIGN PATENT DOCUMENTS

| | | | |
|---|---|---|---|
| 182901 | 4/1907 | Fed. Rep. of Germany | 269/46 |

*Primary Examiner*—Werner H. Schroeder

*Assistant Examiner*—Andrew M. Falik

*Attorney, Agent, or Firm*—Basile, Weintraub & Hanlon

[57] ABSTRACT

A sewing machine operating station which cooperates with an overhead conveyor system having a number of trolleys which convey partly-formed garments between working stations, each trolley having a delivery arm from which garments can be suspended, and delivered to a working station. Each working station comprises a table, a sewing machine mounted on the table, and a working surface adjacent to the sewing machine and onto which a partly-formed garment can be placed in order to undergo a sewing operation. An inverted L-shaped guide is mounted on the table and can be coupled-up with the delivery arm of a trolley so as to guide a supply of partly-formed garments, suspended therefrom, to a position adjacent to the working surface. In addition, the working surface comprises a first part which is located adjacent to the sewing machine and a second part which can be moved between a first position in which it adjoins the first part to form a joint substantially horizontal working surface for one mode of operation of the station, and a second position in which it extends downwardly of the first part so that the first part only forms a substantially horizontal working surface for a second mode of operation of the station.

15 Claims, 6 Drawing Figures

DETACHABLE GUIDE FOR A SEWING MACHINE OPERATING STATION

FIELD OF THE INVENTION

This invention relates to a sewing machine operating station for use in the fabrication of garments.

In large scale garment manufacture, it is usual to position a considerable number of sewing machine operating stations on an assembly line, at which successive sewing operations are carried out in the joining-together of pre-cut pieces of cloth in order to form the required garment. It is usual to provide some type of conveyor system to convey the partly formed garments to the operative at each station, and to remove the garments from each station after the necessary sewing operations have been carried out at that station. The garments may then be conveyed to further stations, if further sewing or other operations are required, or conveyed to finishing and dispatch stations.

Some of the conveying systems used to date are relatively unsophisticated, in that they merely convey the articles to positions close to the stations, and the operatives then lift-off each article from the conveying system and place it on a sewing machine table provided at the station. It may even be necessary for the operative to stand up in order to remove the article from the conveying system, and subsequently to return the machined article to the system. Thus, there is inevitably intermittent operation of the system , with frequent interruptions to the operatives, which is not conducive to efficient operation.

There are also more sophisticated conveying systems which provide automatic conveyance of articles to the operatives at each working station, but these systems are both complicated and expensive, and are not readily adaptable to suit a different operating condition consequent upon a change of garment style.

In addition to the disadvantages of the current designs of conveying systems, there are also problems with the constructions of sewing tables currently provided at each station, in or on which a sewing machine is mounted. The existing constructions of sewing tables cannot readily be altered to suit the different modes of use which are usually required in a garment-making factory. Thus, there are some occasions in which it is necessary to provide a large flat working surface adjacent to the sewing machine, onto which the partly formed garment is placed, and there are other occasions in which only a small working surface is required so that the machining of the garment is carried out in a "waterfall manner" i.e. the garment is allowed to flow over the edge of the working surface and to fall under gravity as sewing proceeds.

With the currently available constructions of sewing machine table, it is a major operation to alter the table at each station by bolting-on or unbolting separate attachments to the basic table. When the attachments are not in use, they have to be stored in a safe place ready for future need. Therefore, it will be evident that it is a major operation to convert all of the working stations in a garment factory, when there is a style change necessitating different operating conditions at each station. In some factories, alteration is necessary to the working stations every six to eight weeks, and with more frequent style changes there is an even shorter interval between alterations to the working station.

SUMMARY OF THE INVENTION

Accordingly, there has developed a need to provide (1) an improved means for conveying partly formed garments to a sewing machine station which will permit the operative to operate with less interruptions in handling the garments and therefore operate more efficiently and (2) an improved construction of sewing table which can be more readily converted between different modes of use.

According to one aspect of the invention there is provided a sewing machine operating station comprising a table, a sewing machine mounted in or on the table, a working surface adjacent to the sewing machine onto which a partly-formed garment can be placed in order to undergo a sewing operation, characterised by a guide mounted on the table and arranged so as to guide a supply of partly-formed garments, suspended therefrom, to a position adjacent to the working surface.

It is preferred that the guide comprises an L-shaped member having a first limb which extends upwardly from the table and a second limb which extends generally horizontally over the working surface. Partly formed garments can readily be suspended from the guide by means of detachable fasteners connected to rings which slide along the second limb. The operatives at the sewing stations can readily reach out for a new piece of work, without moving from a working position (usually seated) adjacent to the sewing machine.

In order to allow the sewing station to be readily converted to operate with different lengths and/or styles of garment, it is preferred that the guide should be adjustably mounted on the table for movement vertically and/or horizontally relative to the working surface.

Conveniently, the guide is adapted to be coupled-up with an overhead conveyor system which is provided in a factory in order to convey the garments to the working stations. One construction of conveyor system which is particularly, though not exclusively, suitable for use with the sewing machine operating station according to the invention comprises an overhead rail system running the length of an assembly line in a factory, and from which individual trolleys are suspended. Garments are suspended by releasable fasteners from rings which are slid along a generally horizontal carrier bar provided on each trolley. Each carrier bar has a hollow end, and it is preferred that the guide be provided with a coupling which can readily be fitted into, and subsequently removed from this hollow end. This then allows a supply of garments to be delivered to each station, and then the operative can "thread" the garments one by one, or in a batch, onto the second limb of the guide by sliding the rings along the carrier bar, over the coupling, and onto the second limb of the guide. After sewing has been completed on each garment, it is re-attached to the second limb of the guide (if it has been necessary to detach the garment to carry out the sewing operations) and then the entire batch can be returned to the trolley by sliding back along the coupling and onto the carrier bar. The coupling is released, and the trolley can then be conveyed along the rail to other parts of the factory.

One particularly suitable arrangement of coupling comprises an elongate and flexible member which extends within the guide and which can be push-fitted into the hollow end of the carrier bar. Preferably, a crimp is provided in the hollow end of the carrier bar, in order to retain the coupling in the end of the carrier bar. The elongate and flexible member may comprise a length of pipe which is taken through the first and second limbs of the guide. The free end of the second limb may have a bevelled end in order to facilitate sliding movement of the rings from the coupling pipe onto the second limb. By providing a simple flexible pipe as the coupling, the guide can readily cooperate with the trolley (which does not move vertically) despite any vertical adjustment of the guide which may be carried out to suit a change of garment style.

When the guide is raised, the distance between the second limb of the guide and the carrier bar will diminish, but any surplus of protruding coupling pipe can readily be removed by withdrawing the opposite end portion of the coupling pipe from the lower end of the first limb of the guide. Thus, there will be no impediment to smooth transfer of garments from the carrier bar of the trolley to the second limb, regardless of the adjusted height of the guide relative to the working surface. Similarly, the coupling pipe can also readily accommodate any horizontal adjustment movement of the guide.

According to a second aspect of the invention there is provided a sewing machine operating station comprising a table, a sewing machine mounted in or on the table, and a working surface adjacent to the sewing machine, characterised in that the working surface comprises a first part which is located adjacent to the sewing machine and a second part which can be moved between a first position in which it adjoins the first part to form a joint substantially horizontal working surface for one mode of operation of the station and a second position in which it extends downwardly of the first part so that the first part only forms a substantially horizontal working surface for a second mode of operation of the station.

Preferably, the second part is pivotally mounted on the table at a position adjacent to the outward edge of the first part for movement between its first and second positions. Conveniently, the second part is connected to the table by a hinge connection which permits generally pivotal movement of the second part, but which has a toggle linkage which allows limited generally horizontal movement of the second part to and from self-latching in the first position.

Vertical support for the second part, when in the first position, is preferably provided by a leg pivotally mounted on the framework of the table for movement about a generally vertical axis between a supporting position below the second part and a disabled position which allows the second part to be pivoted downwardly to its second position.

The sewing machine station can be operated with the joint working surface formed by the first and second parts when the nature of the garment being formed requires a large flat surface adjacent to the sewing machine. Alternatively, when sewing is to be carried out according to the "waterfall principle", the second part takes-up its second position in which it allows a garment to flow downwardly alongside the second part as sewing progresses.

To provide ready access to the sewing machine when, as is preferred, it is partly sunk into the table, the first part of the working surface may be pivotally mounted for movement between a first position in which it operates as a working surface and a second position in which it allows access to be had to the sewing machine for maintenance or other operations.

The invention is also concerned with a sewing machine operating station having the combined features of the first and second aspects of the invention, with or without any of the preferred features provided for each aspect, as referred to above.

A sewing machine operating station according to the invention will now be described in detail, by way of example only, with reference to the accompanying drawings

DESCRIPTION OF PREFERRED EMBODIMENT

Figure 1:
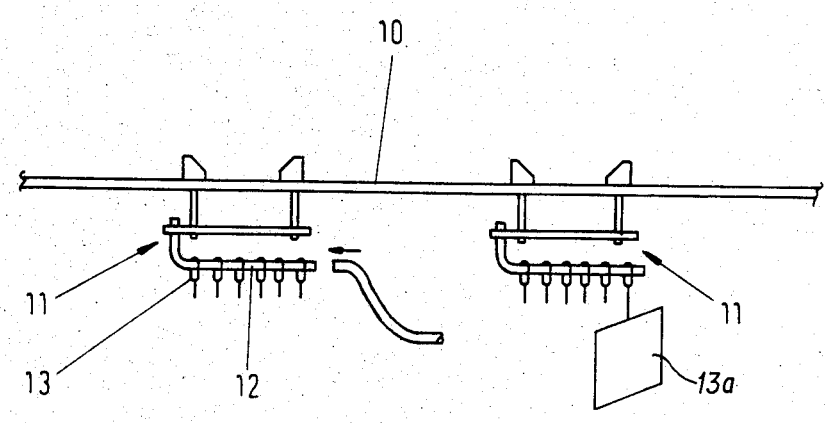
FIG. 1 is a schematic illustration of an overhead conveyor system which is provided in a garment-making factory in order to convey partly-formed garments to sewing machine operating stations in an assembly line.

Referring now to FIG. 1 of the drawings, there is shown an overhead conveyor system which is provided in a factory in order to convey partly-formed garments to a number of sewing machine working stations arranged in an assembly line in the factory. The conveyor system comprises an overhead rail 10, and a series of trolleys 11 which are suspended from the rail 10 and which are moveable along the rail to various working stations. Each trolley 11 has a delivery arm in the form of a substantially horizontal carrier bar 12 on which rings 13 are slid, each ring 13 suspending a garment therefrom, one of which is shown at 13*a* in FIG. 1, via a suitable releasable fastener. When the trolley 11 is conveying work to be done at the working stations, the garments will be only partly-formed, but when the trolleys 11 are taking away finished work from the working stations, then the garments will be further formed, or completed, for subsequent conveyance to other working stations, or finishing and dispatch stations in the factory.

Figure 2:
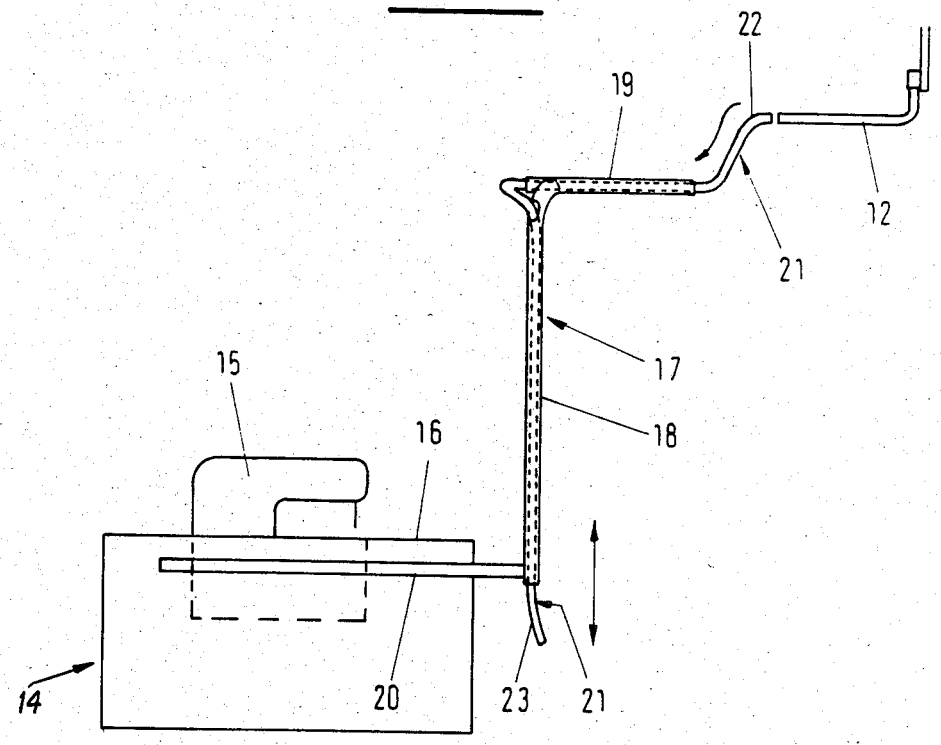
FIG. 2 is a rear view of a sewing machine operating station.
Figure 3:
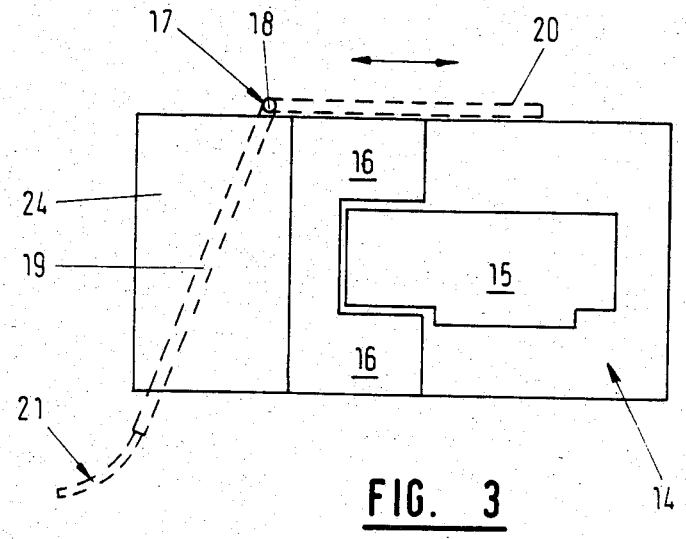
FIG. 3 is a plan view of the operating station.
Figure 4:
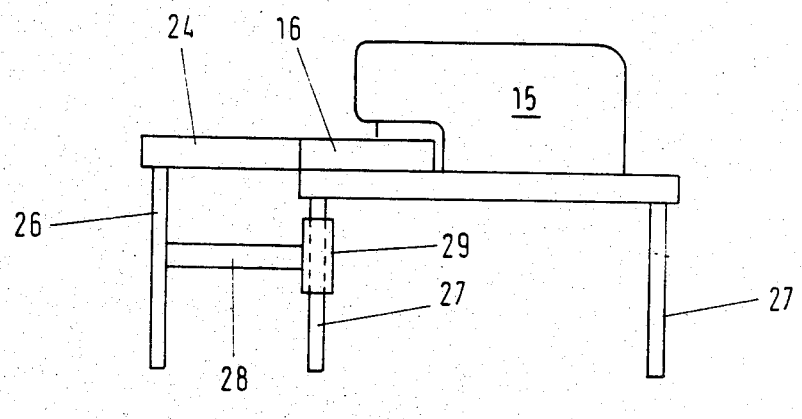
FIG. 4 is a front view of the operating station, but with a garment-guide omitted for the sake of clarity.

A sewing machine working station according to the invention is shown in FIG. 2, and comprises a table 14, a sewing machine 15 partly sunk into the table 14, and a working surface comprised of two parts, a first part 16 adjacent to the sewing machine 15 onto which a partly-formed garment can be placed in order to undergo a sewing operation. A guide 17 is mounted on the table 14 and is arranged so as to guide a supply of partly-formed garments, suspended therefrom, to a position adjacent to the first part of the working surface 16. The guide 17 comprises an inverted L-shaped member having a first limb 18 which extends upwardly from the table and a second limb 19 which extends generally horizontally over the working surface provided for the sewing station (only the first part of the working surface is shown at 16 in FIG. 2, and further parts are shown in FIGS. 3 and 4). The second limb 19 is slightly upwardly inclined relative to the first limb 18, to assist in sliding movement of the garments along the limb 19, as described in more detail below. Garments are suspended from the second limb 19 in the same way in which they are suspended from the carrier bar 12 of a trolley 11, and the rings 13 are readily slid from the carrier bar 12 onto the second limb 19 of the guide 17. When a garment is suspended from the second limb 19, an operative sitting the sewing machine 15 can readily reach out for this new piece of work without moving from the seated position.

The guide 17 is rigidly mounted on the sewing table 14 via a releasable coupling (not shown) with a horizontal support bar 20 fastened along the back face of the table 14. The height of the second limb 19 can readily be adjusted relative to the height of the working surface by vertical adjustment on the support bar 20. In addition, the guide can be horizontally adjusted, by horizontal adjustment of the bar 20 relative to the back of the table 14. The provision of means for adjusting the guide vertically and/or horizontally relative to the working surface enables the sewing station to be readily converted to operate with different lengths and/or styles of garment.

As shown in FIG. 2, the guide 17 is adapted to be statically coupled-up with the carrier bar 12 of trolley 11 of the overhead conveyor system. Each carrier bar 12 has a hollow end, and the coupling for the guide 17 is an elongate and flexible member which can be plugged-in to the end of the carrier bar 12. In one preferred arrangement, the coupling comprises a length of tube 21 which is taken through the first limb 18 and second limb 19 of the guide 17. The free end portion 22 of the coupling pipe is drawn-out to an appropriate length from the free end of the limb 19 to enter the end of the carrier bar 12 and provide a smooth transition path for the rings 13 as they are slid from the carrier bar 12 over the coupling tube 21 and onto the limb 19. To facilitate transfer onto the limb 19, conveniently a bevelled end is provided on the free end of the limb 19. If there should be an excessive amount of pipe projecting from the limb 19, then the other end 23 of the pipe can be pulled so as to remove the surplus. This will usually be necessary when the height of the guide 17 has been increased during a change of operating mode of the sewing station to suit a different style of garment.

Referring to FIG. 3, this shows a plan view of the sewing table 14. Also, FIG. 3 shows the guide 17 in dotted outline , to illustrate the manner by which it is arranged in relation to the working surface of the sewing table. As was referred to above, the first part 16 forms only one part of the working surface which can be provided for one mode of operation of the sewing station. Thus, a second part 24 is provided, which cooperates with the first part 16 to form a joint working surface. It will then be seen from FIG. 3 that the second limb 19 of the guide 17 (shown in dashed outline only) extends over the working surface, to provide easy access for an operative to reach the garments conveyed to the working surface by the guide 17.

Referring now to FIG. 4, the arrangement of the first part 16 and the second part 24 of the working surface is shown in side view. Evidently, the first part 16 is arranged adjacent to the sewing machine 15, whereas the second part is pivotally connected to the table by a hinge connection (shown schematically at 25 in FIG. 5) adjacent to the outward edge of the first part 16. The second part 24 is pivotable between a first position as shown in FIGS. 3 and 4, in which it adjoins the first part 16 to form a joint substantially horizontal working surface for one mode of operation of the station, and a second position in which it extends downwardly of the first part 16 so that the first part 16 only forms a substantially horizontal working surface for a second mode of operation of the station. The second part 24 is shown in FIG. 5 in an intermediate position between its first and second positions.

When the second part occupies its first position adjoining the first part 16, there is formed a large substantially horizontal working surface, which provides the mode of operation suitable for certain garments which require a large working surface adjacent to the sewing machine. When the second part 24 occupies its second position, only the first part 16 of the working surface is available as a horizontal working surface, and sewing can be carried out according to the "waterfall principle" in which garments flow over the edge of the first part 16 and downwardly alongside the (substantially vertical) second part 24 as sewing progresses.

In order to support the second part 24 in its first horizontal position, a leg 26 (shown only in FIG. 4) is pivotally mounted on the framework of the table (not shown in detail) for movement about a substantially vertical pivot axis between a supporting position, as shown in FIG. 4, and a disabled position (not shown) in which the second part 24 can be pivoted downwardly to its second position. The leg 26 is pivotally mounted on a rear leg 27 (of four support legs 27) of the main part of the table by means of a strut 28 and a rotatable sleeve 29 mounted on the rear leg 27.

Figure 5:
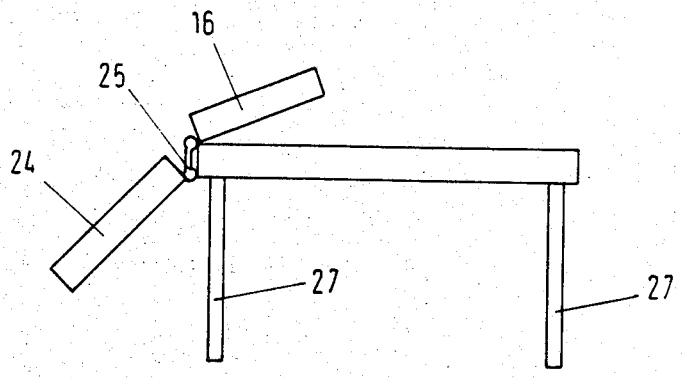
FIG. 5 is a view, similar to FIG. 4, illustrating alternative operating positions for parts of the working station.

The hinge connection 25, shown schematically in FIG. 5, enables the second part 24 to be pivoted upwardly and downwardly, but preferably includes a toggle or other linkage which allows limited generally horizontal bodily movement of the second part 24 to and from self-latching in the first horizontal position.

The first part 16 may, in certain embodiments, be fixed relative to the table. However, in the embodiment illustrated, having a partly sunk sewing machine 15, the first part 16 is pivotally mounted on hinge 25 for movement between a first position (shown in FIG. 4) in which it operates as a horizontal working surface and a second position in which it allows access to be had to the sewing machine for maintenance or other operations. In FIG. 5, the first part 16 is shown only partly raised, though it should be understood that it will be pivoted anticlockwise, as shown in FIG. 5, through in excess of 90 i.e. up to nearly 180 to allow access to be had to the sewing machine.

Figure 6:
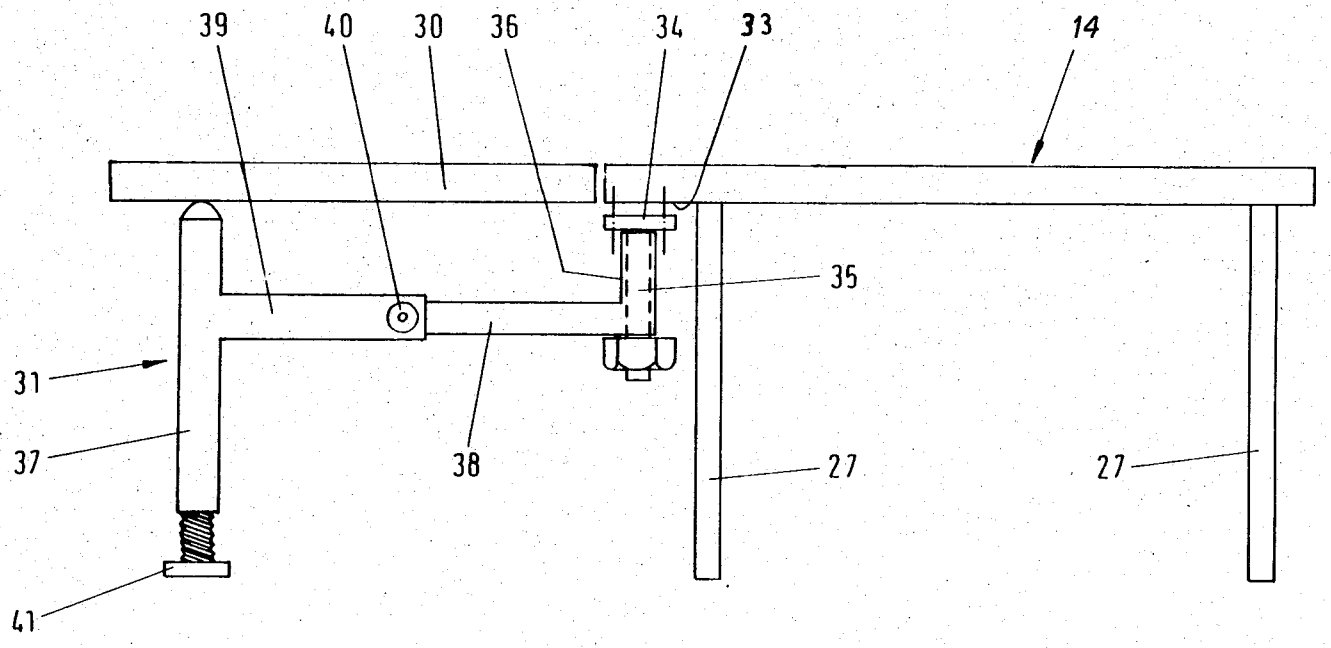
FIG. 6 is a schematic illustration of a modification to a support leg construction shown in FIG. 4.

Referring now to FIG. 6, there is shown a different arrangement of pivotable support leg to that shown in FIG. 4. An existing construction of sewing machine table 14 can be adapted to operate as a working station according to the invention by providing a hinged side flap 30 which is supported by a swinging leg 31. The swinging leg 31 can be mounted at any convenient place along the underside of side edge 33 of the table 14, and comprises a mounting flange 34 which is bolted to the side edge 33, a vertical pivot 35 depending from the flange 34 and housed within a sleeve 36 rotatable thereon, and a vertically adjustable leg 37 coupled with the sleeve 36 via a horizontally adjustable two part arm 38, 39.

The first part 38 is secured to the sleeve 36, and the second part 39 is secured to the leg 37. The first and second parts are telescopically adjustable, and can be secured in any desired position by means of a locking screw 40.

The leg 31 can readily be swung away from the supporting position, as shown in FIG. 6, to a disabled position which allows the side flap 30 to be swung downwardly alongside of the table.

The ability to mount the leg 31 at any desired position along the edge 33, and to adjust the leg 37 horizontally (via adjustment of parts 38, 39) and vertically (via an adjustable foot 41 of the leg 37) enables many existing constructions of sewing machine worktable to be adapted to form part of a sewing machine operating station according to the invention.

We claim:

1. A sewing machine operating station for use with an overhead conveyor system having a trolley movable therealong and provided with a delivery arm from which partly-formed garments can be suspended, for delivery to the operating station, in which the operating station comprises:

a table;

a sewing machine mounted in or on the table;

a working surface adjacent to the sewing machine and on which a partly-formed garment can rest while undergoing a sewing operation;

a guide mounted on the table and having a guide portion which extends generally horizontally over the working surface; and means for statically coupling a free end of the guide portion with the delivery arm of the trolley in order to permit sliding transfer of a partly-formed garment from the delivery arm to a suspended position on the guide portion.

2. A sewing machine operating station according to 1, in which said coupling means comprises a flexible elongate coupling piece.

3. A sewing machine operating station according to claim 2, in which the flexible elongate coupling piece comprises a length of tube which is capable of push-fit engagement with the end of the delivery arm.

4. A sewing machine operating station according to claim 3, in which the guide portion is hollow so as to receive adjustably the length of tube therein.

5. A sewing machine operating station according to claim 1, in which the guide comprises an inverted L-shaped member having first and second limbs, said first limb extending upwardly from the table and said second limb forming said guide portion.

6. A sewing machine operating station according to claim 1, including a support which adjustably mounts the guide on the table so as to permit vertical and/or horizontal adjustment of the guide relative to the working surface.

7. A sewing machine operating station according to claim 1, in which said working surface comprises a first part which is located adjacent to the sewing machine and a second part which is movable betwen a first position in which it adjoins the first part to form a joint substantially horizontal working surface for one mode of operation of the station and a second position in which it extends downwardly of the first part so that only the first part forms a substantially horizontal working surface for a second mode of operation of the station.

8. A sewing machine operating station according to claim 7, in which the second part is pivotally mounted at a position adjacent to the outward edge of the first part.

9. A sewing machine operating station according to claim 8, including a hinge connection having a toggle linkage which allows limited generally horizontal movement of the second part to and from self-latching, in its first position, with said first part.

10. A sewing machine operating station according to claim 7, including a leg pivotally mounted on the framework of the table for movement betwen a supporting position for the second part and a disabled position allowing the second part to pivot to its second position.

11. A sewing machine operating station according to claim 7, in which the working surface is U-shaped, as seen in plan, so as to embrace the sewing machine, and is pivotally mounted on the table for movement between a working position and an inspection position allowing access to the sewing machine.

12. A sewing machine operating station comprising:

a table;

a sewing machine mounted in or on the table;

a working surface adjacent to the sewing machine onto which a partly formed garment can be placed in order to undergo a sewing operation;

an inverted L-shaped guide member having a first limb mounted on the table which extends upwardly from the table, and a second limb which extends generally horizontally over the working surface, is detachably coupled with a delivery arm of a trolley of an overhead conveyor system, wherein the guide member is arranged so as to guide a supply of partly-formed garments, suspended therefrom, to a position adjacent to the working surface; and a flexible, elongate coupling piece for statically coupling together the second limb and the delivery arm.

13. The sewing machine operating station according to claim 12, in which the guide is mounted on the table via a support which allows vertical and/or horizontal adjustment of the guide relative to the working surface.

14. The sewing machine operating station according to claim 12, in which the flexible coupling piece comprises a length of tube which is push-fitted into engagement with the delivery arm.

15. The sewing machine operating station according to claim 14, in which at least the second limb and also the first limb are hollow to receive adjustably the length of tube therein.

* * * * *